US005183413A

United States Patent [19]

Lazaro, Jr. et al.

[11] Patent Number: 5,183,413

[45] Date of Patent: * Feb. 2, 1993

[54] MODULAR, CIRCULAR, ENVIRONMENT RESISTANT ELECTRICAL CONNECTOR ASSEMBLY HAVING RETENTION CLIPS FOR MANUALLY OR AUTOMATICALLY LOADING OF ELECTRICAL CONTACTS

[75] Inventors: Luis J. Lazaro, Jr., Seattle; Franklin D. Harsch, Renton, both of Wash.

[73] Assignee: The Boeing Company, Seattle, Wash.

[ * ] Notice: The portion of the term of this patent subsequent to Jan. 1, 2008 has been disclaimed.

[21] Appl. No.: 807,620

[22] Filed: Dec. 13, 1991

Related U.S. Application Data

[63] Continuation of Ser. No. 588,117, Sep. 25, 1990, abandoned, which is a continuation-in-part of Ser. No. 454,213, Dec. 21, 1989, abandoned.

[51] Int. Cl.[5] ..... H01B 13/40

[52] U.S. Cl. ..... 439/589; 439/281; 439/587

[58] Field of Search ..... 439/271, 277, 281, 587, 439/589, 592, 599, 603

[56] References Cited

U.S. PATENT DOCUMENTS

| | | | |
|---|---|---|---|
| 3,840,841 | 10/1974 | Clark | 439/589 |
| 3,953,099 | 4/1976 | Wilson | 439/281 |
| 4,981,446 | 1/1991 | Lazaro, Jr. et al. | 439/589 |

*Primary Examiner*—Paula A. Bradley

*Attorney, Agent, or Firm*—Conrad O. Gardner; B. A. Donahue

[57] ABSTRACT

An electrical connector modularly arrayed wherein electrical contacts either manual or automatic assemble through a grommet assembly into retention clips.

6 Claims, 2 Drawing Sheets

MODULAR, CIRCULAR, ENVIRONMENT RESISTANT ELECTRICAL CONNECTOR ASSEMBLY HAVING RETENTION CLIPS FOR MANUALLY OR AUTOMATICALLY LOADING OF ELECTRICAL CONTACTS

RELATED APPLICATIONS

This application is a continuation of copending application Ser. No. 07/588,117 filed on Sep. 25, 1990, now abandoned, which is a continuation in part of Ser. No. 07/454,213 filed on Dec. 21, 1989 now abandoned.

This invention relates to an electrical connector modularly arrayed as the electrical connector in U.S. application Ser. No. 432,429 filed Nov. 6, 1989 now Pat. No. 4,981,446 and also assigned to The Boeing Company, however further configured to include retention clips for manual or automatic assembly of the electrical contacts in the connector as hereinafter described.

SUMMARY OF THE INVENTION

A preferred embodiment of the present invention utilizes an electrical connector having a connector cable clamp (backshell) and grommet assembly which is loaded with electrical contacts using a pneumatic contact loader which is then assembled onto the connector shell.

It is an object of the present invention to provide a method and apparatus enabling automation and robotic fabrication and assembly of electrical/electronic wire bundle assemblies.

A further object of the present invention includes a circular, modular connector assembly characterized by elimination of the insertion tool which results in a making of an improved and more reliable environment resisting connector.

DETAILED DESCRIPTION OF THE INVENTION

Figures 1, 2, 3, 4:
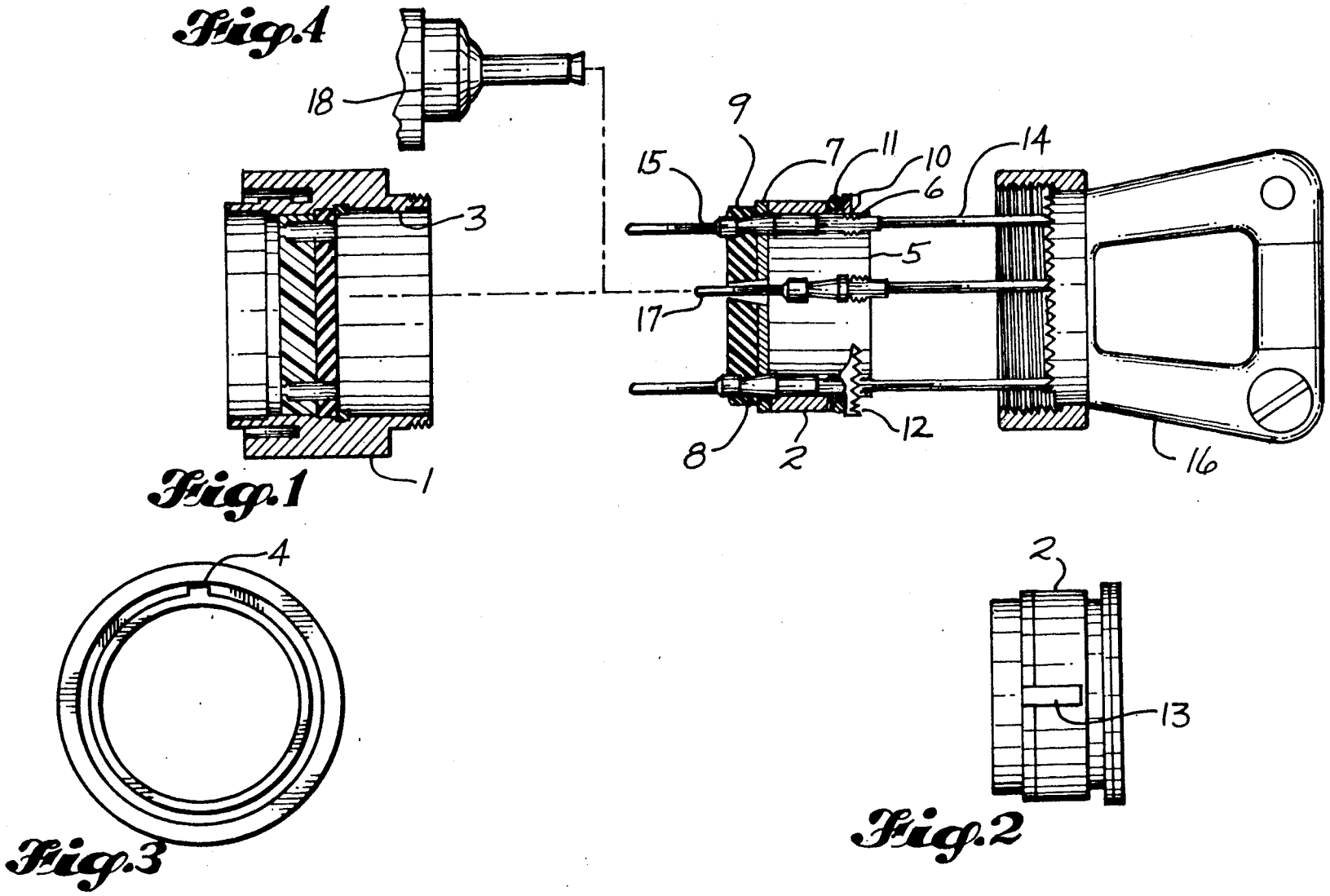
FIG. 1 is a cross sectional view illustrative of the assembly of the present modular connector, and included in the illustration is a connector cable clamp or backshell further showing a grommet assembly being loaded with electrical contacts using a pneumatic contact loader which is subsequently assembled onto the connector shell.
FIG. 2 is a side elevational view of the grommet assembly.
FIG. 3 is an end view (face) of the connector shell where the master keyway on the receptacle face is highlighted.
FIG. 4 is a cross section of the pneumatic loader illustrating the electrical contacts being pulled into the retention clip; and, FIG. 5 is a cross sectional schematic layout of the pneumatic contact loader.

The new electrical, circular, environment resisting connector utilizes a modular construction consisting of a connector shell 1 and a grommet assembly 2. Included in the illustration in FIG. 1 is a connector cable clamp or backshell 16 and a wired grommet assembly 2 to be loaded onto connector shell 1. The construction of the connector shell is identical to the existing Mil-C-26500, Mil-C-38999, Mil-C-83723 and Mil-C-5015 (as required) with the following modifications:

a) The connector is 0.25 inches longer.

b) Inside diameter is changed to a straight bore, and a alignment key 3 is added. The alignment key 3 is located at the rear end of the connector shell 1 and positioned at 0 degree or 12 O'Clock (same polarization as the connector master keyway 4 receptacle as shown in FIG. 3 or key (plug-not shown).

The grommet assembly 2 (see FIG. 1 and 2) consists of a grommet 5 with sealing webs 6 designed to have a seal range of 0.035–0.090 inch for #20 size contact which eliminates build-up sleeves. Grommet assembly 2 further includes dielectric 7 with retention clips 8, interfacial seal 9 designed to seal the individual holes within the grommet and a pressure ring 10 with an 0-ring 11 for environmental seal and a 360 degree accessory teeth 12 and a keyway 13.

The assembly process (automation or manual) is described below:

a) Strip wire(s) 14.

b) Crimp electrical contact(s) 15 onto wire(s) 14.

c) Insert crimped wires through backshell 16 or coupling ring 16 (not shown).

d) Load contact(s) 15 onto grommet assembly 2. Use thumb to push contact(s) 15 onto grommet 5 (manual assembly) or use a gripper (not shown) to push contact(s) 15 onto grommet 5 (robotic assembly). IMPORTANT: This process enables contact(s) end 17 to extend beyond the grommet assembly 2 (approximately 1/16 to ¼ inch).

e) Use pneumatic contact loader 18 as shown in FIG. 1 and 4 (manual robotic operation) to insert contact(s) 15 into retention clip(s) 8. IMPORTANT: This process also provides the Operator with a tactile and visual verification that the contacts 15 are correctly seated in the retention clips 8.

Figure 5:
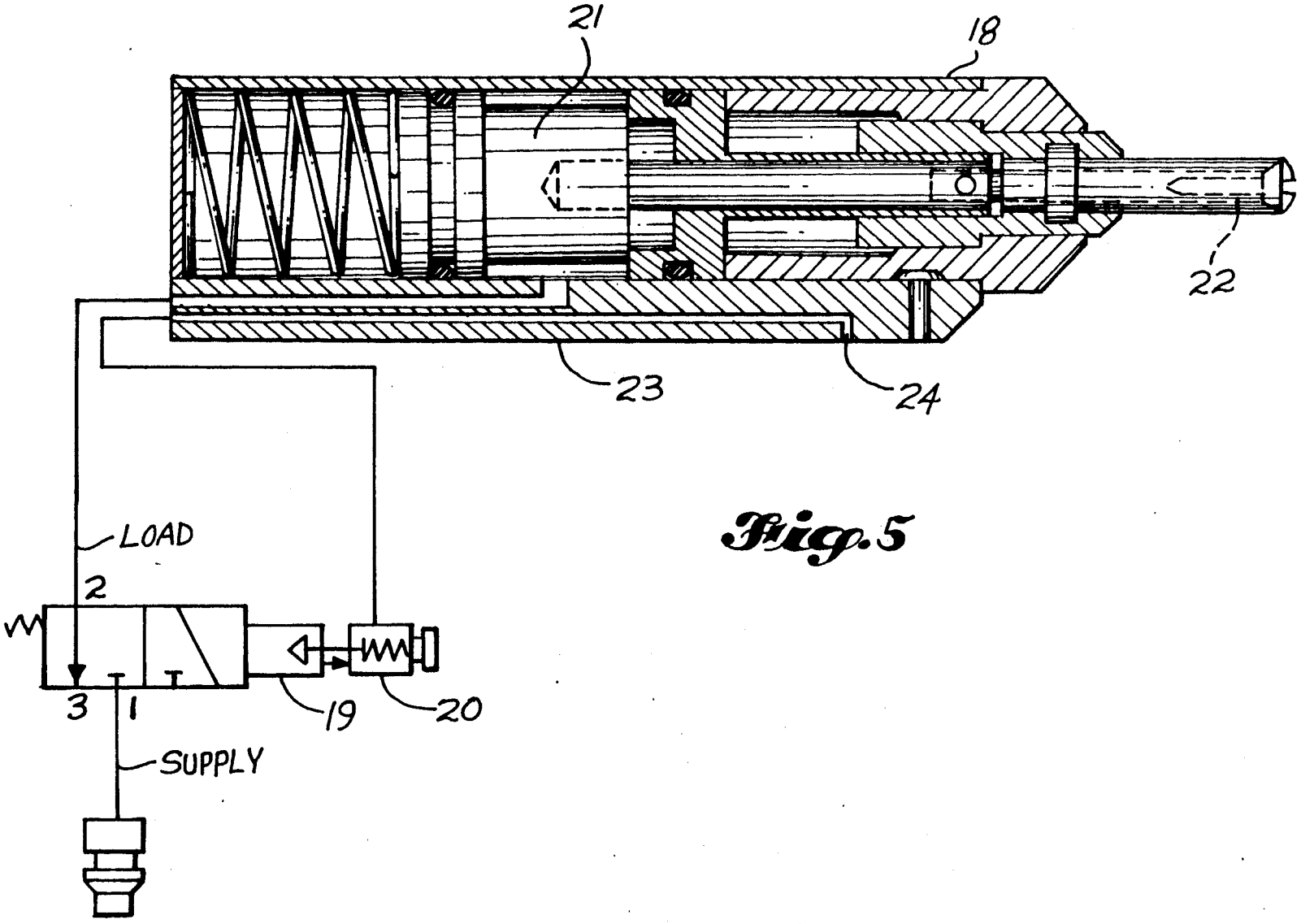

Pneumatic Contact Loader 18 (see FIG. 5) consists of: an air sensor 19, air regulator 20, air cylinder 21 and a collet 22. An air cylinder 21 and collet 22 are housed in a cylindrical shape tube 23. An exhaust (pin) hole 24 located at the tip of the cylindrical tube 23 serves as an on-off switch for the sensor 19. The amount of air blowing thru the exhaust hole 24 is set by the regulator 20 at about 15 psi. Plugging the exhaust hole 24 with the operator's thumb turns off the sensor 19 thus allowing the line pressure to flow and drive the air cylinder 21 which in turn activates the collet 22 to close and grab the electrical contact end 17. The collet 21 will release the contact 15 when the load (force) reaches 15 pounds (same requirement in installing #20 size contact).

f) Align keyway 13 of grommet assembly 2 to alignment key 3 of the connector shell 1 and push grommet assembly 2 inside the connector shell 1.

g) Install backshell 16 or coupling ring 16.

Rework Process

To remove wire(s):

a) Use extraction tool (not shown) to push wire(s) 14 out and discard.

To move and/or replace wire(s):

a) Loosen backshell 16 or coupling ring 16 and slide back.

b) Pull out grommet assembly 2 from connector shell 1.

c) Use extraction tool to push contact(s) 15 out of the retention clip(s) 8.

d) Repeat Steps d thru g.

What is claimed is:

1. An electrical connector assembly comprising a shell adapted for connection to a grommet assembly in alignment therewith;

means associated with said shell and adapted for co-operation with said grommet assembly whereby to allow for their axial engagement and disengagement while preventing their rotation relative to each other;

an environment resisting grommet elastomer having sealing webs with a minimum wire seal of 0.035 in. for No. 20 size electrical contacts and an insulating disc with a plurality of retention clips for assembly of electrical contacts mounted in said grommet assembly.

2. An electrical connector assembly according to claim 1, further including an alignment key disposed at the rear-end of said shell.

3. An electrical connector assembly according to claim 1, wherein a deformable O-ring seal mounted on the outside of said grommet assembly produces a fluid tight environment.

4. An electrical connector assembly according to claim 1, whereby said electrical contacts are pulled into said retention clips utilizing a pneumatic contact loader.

5. An electrical connector assembly according to claim 1, wherein said electrical contacts are inserted into cavities of said grommet elastomer and pulled into said retention clips.

6. An electrical connector assembly according to claim 5, wherein assembly of said electrical contacts inhibit degradation on seal webbings of said grommet elastomer, preserving environmental-resistant property of said electrical connector.

* * * * *